US012492527B2

(12) United States Patent
Li et al.

(10) Patent No.: US 12,492,527 B2
(45) Date of Patent: Dec. 9, 2025

(54) APPARATUS AND METHOD FOR ACTIVELY REDUCING ACTION IMPACT OF EXCAVATOR, AND EXCAVATOR

(71) Applicant: SANY HEAVY MACHINERY LIMITED, Kunshan (CN)

(72) Inventors: Baofeng Li, Kunshan (CN); Xing Wang, Kunshan (CN); Kunpeng Hong, Kunshan (CN)

(73) Assignee: SANY HEAVY MACHINERY LIMITED, Kunshan (CN)

( * ) Notice: Subject to any disclaimer, the term of this patent is extended or adjusted under 35 U.S.C. 154(b) by 258 days.

(21) Appl. No.: 18/307,331

(22) Filed: Apr. 26, 2023

(65) Prior Publication Data

US 2024/0084547 A1 Mar. 14, 2024

Related U.S. Application Data

(63) Continuation of application No. PCT/CN2021/107214, filed on Jul. 20, 2021.

(30) Foreign Application Priority Data

Nov. 25, 2020 (CN) ..... 202011334465.2

(51) Int. Cl.
*E02F 3/43* (2006.01)
*E02F 9/22* (2006.01)

(52) U.S. Cl.
CPC ..... *E02F 3/435* (2013.01); *E02F 9/2203* (2013.01)

(58) Field of Classification Search
CPC ..... E02F 3/43; E02F 3/435; E02F 9/2203
(Continued)

(56) References Cited

U.S. PATENT DOCUMENTS 9,834,908 B2 * 12/2017 Iwasaki ..... E02F 9/2267
10,161,112 B2 * 12/2018 Paull ..... E02F 3/435
(Continued)

FOREIGN PATENT DOCUMENTS

CN 1651666 A 8/2005
CN 1837517 A 9/2006
(Continued)

OTHER PUBLICATIONS

Extended European Search Report issued in counterpart European Patent Application No. 21896347.8, dated Mar. 7, 2024.
(Continued)

*Primary Examiner* — Andrew Joseph Rudy
(74) *Attorney, Agent, or Firm* — Westbridge IP LLC

(57) ABSTRACT

Disclosed are an apparatus and a method for actively reducing an action impact of an excavator, and an excavator, which are related to the technical field of engineering vehicles. The method includes: collecting a boom inclination angle, a stick inclination angle, a bucket inclination angle, and state information of an operating lever, of the excavator; determining operation information of the operating lever, and judging whether the boom inclination angle, the stick inclination angle, and the bucket inclination angle are within set ranges; and controlling, based on a judgment result, operating states of an electronically controlled main valve and a main pump of the excavator. The method may reduce impact and vibration generated during operation of the excavator, thereby reducing a failure rate, and improving service life and work efficiency.

4 Claims, 3 Drawing Sheets

(58) Field of Classification Search
USPC ..... 701/50
See application file for complete search history.

(56) References Cited

U.S. PATENT DOCUMENTS

| | | | | |
|---|---|---|---|---|
| 12,146,293 | B2 * | 11/2024 | Izumi | E02F 3/43 |
| 12,203,238 | B2 * | 1/2025 | Izumi | E02F 9/264 |
| 2017/0145662 | A1 | 5/2017 | Iwasaki et al. | |
| 2017/0314234 | A1 | 11/2017 | Paull et al. | |
| 2022/0025608 | A1 * | 1/2022 | Itoh | E02F 9/2282 |

FOREIGN PATENT DOCUMENTS

| | | | |
|---|---|---|---|
| CN | 102140807 | A | 8/2011 |
| CN | 110409546 | A | 11/2019 |
| CN | 111042245 | A | 4/2020 |
| CN | 112392080 | A | 2/2021 |
| EP | 0486491 | A1 | 5/1992 |
| EP | 0546154 | A1 | 6/1993 |
| EP | 2685011 | B1 | 8/2018 |
| JP | 2004100814 | A | 4/2004 |

OTHER PUBLICATIONS

International Search Report issued in corresponding PCT Application No. PCT/CN2021/107214, dated Oct. 11, 2021.
Written Opinion issued in corresponding PCT Application No. PCT/CN2021/107214, dated Oct. 11, 2021.

* cited by examiner

APPARATUS AND METHOD FOR ACTIVELY REDUCING ACTION IMPACT OF EXCAVATOR, AND EXCAVATOR

CROSS-REFERENCE TO RELATED APPLICATIONS

This application is a continuation of International Application No. PCT/CN2021/107214, filed on Jul. 20, 2021, which claims priority to Chinese Patent Application No. 202011334465.2, filed on Nov. 25, 2020, the disclosures of which are hereby incorporated by reference in their entireties.

TECHNICAL FIELD

The present disclosure relates to the technical field of engineering vehicles, and in particular, to an apparatus and a method for actively reducing action impact of an excavator, and an excavator.

BACKGROUND

Generally, a working apparatus of an excavator is driven by an operating lever. A skilled excavator operator can accurately and stably operate the work apparatus, thereby reducing an impact on the working apparatus. However, for an inexperienced operator, it is not easy to finely manipulate the operating lever, but easy to unstably manipulate the operating lever. Therefore, when the working apparatus is moved to a limit position or is stopped suddenly by manipulating the operating lever, a strong impact caused by inertia of the working apparatus is generated, thereby causing damage to equipment, and reducing working efficiency.

SUMMARY

A purpose of the present disclosure is to provide an apparatus and a method for actively reducing an action impact of an excavator, and an excavator, to reduce an impact and vibration generated during operation, thereby reducing a failure rate, and improving service life and work efficiency.

An embodiment of the present disclosure is realized as follows.

According to an aspect of an embodiment of the present disclosure, a method for actively reducing an action impact of an excavator is provided, including:

collecting a boom inclination angle, a stick inclination angle, a bucket inclination angle, and state information of an operating lever, of the excavator; determining operation information of the operating lever, and judging whether the boom inclination angle, the stick inclination angle, and the bucket inclination angle are within set ranges; and controlling, based on a judgment result, operating states of an electronically controlled main valve and a main pump of the excavator.

Optionally, the judging whether the boom inclination angle, the stick inclination angle, and the bucket inclination angle are within set ranges includes:

judging whether a boom real-time angle $\alpha_1$ is within a set value range of $\alpha_2$ to $\alpha_3$ of a boom movement angle, where the set value range of $\alpha_2$ to $\alpha_3$ of the boom movement angle is a safe zone for a boom movement; judging whether a stick real-time angle $\beta_1$ is within a set value range of $\beta_2$ to $\beta_3$ of a stick movement angle, where the set value range of $\beta_2$ to $\beta_3$ of the stick movement angle is a safe zone for a stick movement; and judging whether a bucket real-time angle $\gamma_1$ is within a set value range of $\gamma_2$ to $\gamma_3$ of a bucket movement angle, where the set value range of $\gamma_2$ to $\gamma_3$ of the bucket movement angle is a safe zone for a bucket movement.

Optionally, the judging whether the boom inclination angle, the stick inclination angle, and the bucket inclination angle are within set ranges further includes:

judging whether a change rate of the boom real-time angle satisfies $\alpha_1/\Delta_t>\Delta_\alpha$, or whether a change rate of displacement of the operating lever in a movement direction of controlling the boom satisfies $L_A/\Delta_t>\Delta V_A$; judging whether a change rate of the stick real-time angle satisfies $\beta_1/\Delta_t>\Delta_\beta$, or whether a change rate of displacement of the operating lever in a movement direction of controlling the stick satisfies $L_B/\Delta_t>\Delta V_B$; and judging whether a change rate of the bucket real-time angle satisfies $\gamma_1/\Delta_t>\Delta_\gamma$, or whether a change rate of displacement of the operating lever in a movement direction of controlling the bucket satisfies $L_C/\Delta_t>\Delta V_C$, where $\Delta_\alpha$ is a critical value of a change rate of a boom angle, $\Delta_\beta$ is a critical value of a change rate of a stick angle, $\Delta_\gamma$ is a critical value of a change rate of a bucket angle, $\Delta V_A$ is a critical value of the change rate of the displacement of the operating lever in the movement direction of controlling the boom, $\Delta V_B$ is a critical value of the change rate of the displacement of the operating lever in the movement direction of controlling the stick, $\Delta V_C$ is a critical value of the change rate of the displacement of the operating lever in the movement direction of controlling the bucket, $L_A$ is a displacement of the operating lever in the movement direction of controlling the boom, $L_B$ is a displacement of the operating lever in the movement direction of controlling the stick satisfies, $L_C$ is a displacement of the operating lever in the movement direction of controlling the bucket, and $\Delta_t$ is time duration of change.

Optionally, the judging whether the boom inclination angle, the stick inclination angle, and the bucket inclination angle are within set ranges further includes: when the boom real-time angle $\alpha_1$ is outside the set value range of $\alpha_2$ to $\alpha_3$ of the boom movement angle, judging whether an absolute value of a difference between the boom real-time angle $\alpha_1$ and $\alpha_{Min}$ is less than or equal to $\alpha_2$, or an absolute value of a difference between $\alpha_1$ and $\alpha_{Max}$ is less than or equal to $\alpha_3$, $\alpha_{Max}$ is a maximum of the boom movement angle, and $\alpha_{Min}$ is a minimum of the boom movement angle.

Optionally, the judging whether the boom inclination angle, the stick inclination angle, and the bucket inclination angle are within set ranges further includes: when the stick real-time angle $\beta_1$ is outside the set value range of $\beta_2$ to $\beta_3$ of the stick movement angle, judging whether an absolute value of a difference between the stick real-time angle $\beta_1$ and $\beta_{Min}$ is less than or equal to $\beta_2$, or an absolute value of a difference between $\beta_1$ and $\beta_{Max}$ is less than or equal to $\beta_3$, where $\beta_{Max}$ is a maximum of the stick movement angle, and $\beta_{Min}$ is a minimum of the stick movement angle.

Optionally, the judging whether the boom inclination angle, the stick inclination angle, and the bucket inclination angle are within set ranges further includes: when the bucket real-time angle $\gamma_1$ is outside the set value range of $\gamma_2$ to $\gamma_3$ of the bucket movement angle, judging whether an absolute value of a difference between the bucket real-time angle $\gamma_1$ and $\gamma_{Min}$ is less than or equal to $\gamma_2$, or an absolute value of a difference between $\gamma_1$ and $\gamma_{Max}$ is less than or equal to $\gamma_3$, where $\gamma_{Max}$ is a maximum of the bucket movement angle, and $\gamma_{Min}$ is a minimum of the bucket movement angle.

According to another aspect of an embodiment of the present disclosure, an apparatus for actively reducing an action impact of an excavator is provided, including: a controller module, and a sensor module and an operation module electronically connected to the controller module respectively, where the sensor module comprises an operating lever connected to the controller module, a boom inclination angle sensor disposed on a boom, a stick inclination angle sensor disposed on a stick, and a bucket inclination angle sensor disposed on a bucket; the operation module comprises a main pump and an electronically controlled main valve respectively connected to the controller module; and the controller module is configured to control, based on information collected from the sensor module and the operating lever, output flow of the main pump, and flow and pressure of each branch delivered by the electronically controlled main valve.

Optionally, the controller module includes a sensor signal collection component, a data preprocessing component, a calculation component, and a control component.

Optionally, the apparatus for actively reducing the action impact of the excavator further includes: a boom cylinder, a stick cylinder, and a bucket cylinder, wherein the boom cylinder is connected to the boom by drive connection, the stick cylinder is connected to the stick by drive connection, the bucket cylinder is connected to the bucket by drive connection, and the boom cylinder, the stick cylinder and the bucket cylinder are respectively connected to the electronically controlled main valve.

Optionally, the apparatus for actively reducing the action impact of the excavator further includes: a display screen, where the display screen is electronically connected to the controller module.

According to another aspect of an embodiment of the present disclosure, an excavator is provided, including the apparatus for actively reducing the action impact of the excavator of any one of above aspects.

The beneficial effects of the embodiment of the present disclosure are as follows.

According to the apparatus, and the method for actively reducing the action impact of the excavator, and the excavator according to the embodiments of the present disclosure, by collecting a boom inclination angle, a stick inclination angle, and a bucket inclination angle; positions of the boom, the stick, and the bucket may be obtained and then whether it is in a limit position or in a situation where a movement state is suddenly changed and so on may be learned based on a position attitude. After the above situation are learned, a current operation instruction of the operator may be learned based on state information of the operating lever, and an actual control instruction may be determined with reference to the current attitude information of the boom, the stick and the bucket. The operating state of an electronically controlled main valve and a main pump may be controlled by the control instruction, thereby reducing an impact and vibration generated during operation, reducing a failure rate, improving service life and work efficiency.

BRIEF DESCRIPTION OF THE DRAWINGS

To explain the technical solution of embodiments of the present disclosure more clearly, accompanying drawings used in the embodiments will be briefly introduced below. It should be understood that the following accompanying drawings only show some embodiments of the present disclosure, and should not be regarded as a limitation of scope. For those skilled in the art, other relevant accompanying drawings may also be obtained based on these accompanying drawings without any inventive efforts.

DETAILED DESCRIPTIONS OF THE EMBODIMENTS

Figure 1:
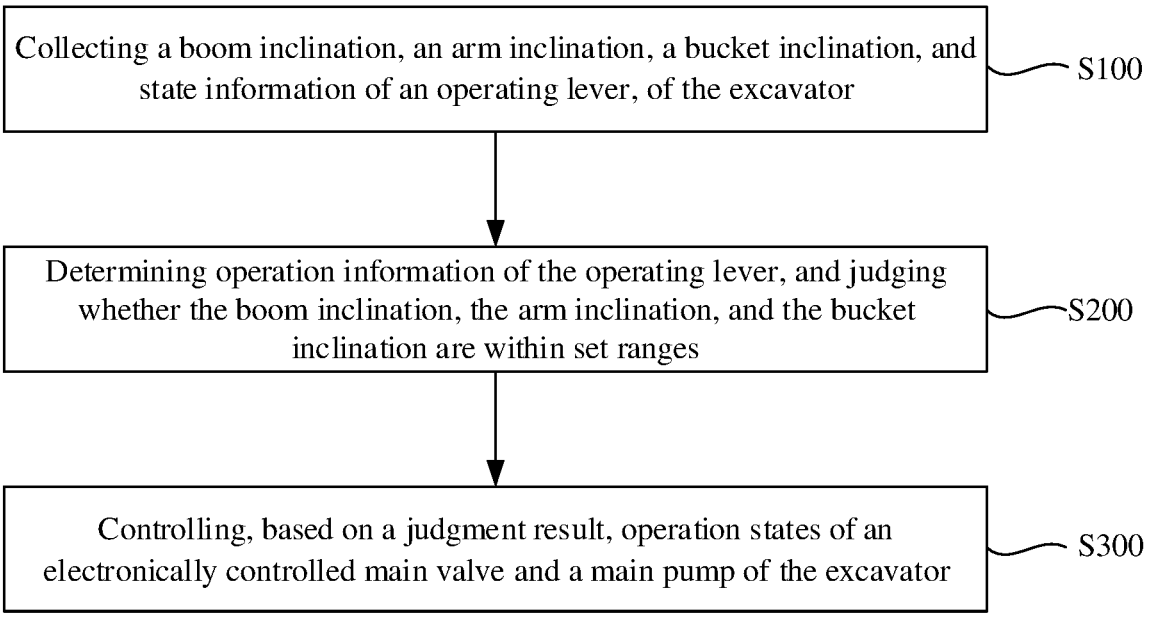
FIG. 1 is a flowchart of a method for actively reducing action impact of an excavator according to an embodiment of the present disclosure.

To make the purpose, technical solutions and advantages of the present disclosure more clear, a clear and complete description of the technical solutions in embodiments of the present disclosure is given below with reference to accompanying drawings of the embodiments of the present disclosure. Apparently, the described embodiments are only a part, but not all of the embodiments of the present disclosure. Modules in the embodiments of the present disclosure, which are described and shown in the accompanying drawings, may be arranged and designed in various different configurations.

Therefore, detailed description of the embodiments of the disclosure shown in the accompanying drawings below is not intended to limit a scope protected by the present disclosure, but to represent selected embodiments of the disclosure. All of the other embodiments that may be obtained by those skilled in the art based on the embodiments in the present disclosure without any inventive efforts fall into the scope protected by the present disclosure.

It should be noted that similar symbols and letters represent similar labels in the accompanying drawings; therefore, once a label is defined in one figure, it is not necessary to further define and explain the label in the subsequent accompanying drawings.

In the description of the present disclosure, it should be noted that an orientation relationship or a position relationship indicated by the terms "up", "inside", "outside" and so on is based on an orientation relationship or a position relationship shown in the accompanying drawings, or is an orientation relationship or a position relationship in which a product is usually placed, only to simplify the description of the present disclosure, rather than indicate or imply that the referred apparatus or elements must have a specific orientation, or be constructed and operated in a specific orientation, thereby it cannot be understood as a limitation on this disclosure.

In the description of the present disclosure, it should also be noted that the terms "dispose" and "connection" should be understood in a broad sense, unless specified and limited otherwise, for example, the connection may be a fixed connection, a removable connection, or an integrated connection; it may be a mechanical connection, or an electrical connection; it may be a direct connection, or an indirect connection through intermediate media, or it may be an internal connection of two modules. For those skilled in the art, the specific meaning of the above terms in the disclosure may be understood in specific circumstances.

In a situation that an operator needs to operate an excavator quickly to improve the working efficiency, when the operator quickly manipulates the operating lever to perform an operation action, an impact caused by a quick start or a quick stop of the working apparatus may result in a strong vibration of the excavator, which may further increase work fatigue of the operator, thereby reducing the work efficiency, increasing a failure rate of the working apparatus, and affecting its service life.

Referring to FIG. 1, a method for actively reducing an action impact of an excavator is provided in an embodiment of the present disclosure, including the following steps.

S100: Collecting a boom inclination angle, a stick inclination angle, a bucket inclination angle, and state information of an operating lever, of the excavator.

Specifically, by collecting the boom inclination angle, the stick inclination angle, the bucket inclination angle, and the state information of the operating lever of the excavator, it may be learned that whether the excavator moves to a limit position during working or a movement state of the excavator is suddenly changed. Sudden changes of movement state include, for example, whether it starts suddenly from a standstill, whether it stops suddenly from a motion state, or whether a movement direction of the excavator is suddenly changed and so on. Thereby, it is convenient to learn a current operation based on collected information, so as to optimize the corresponding operation control.

S200: Determining operation information of the operating lever, and judging whether the boom inclination angle, the stick inclination angle, and the bucket inclination angle are within set ranges.

Specifically, when the operating lever is manipulated, control instructions of an operator may be obtained based on state information of the operating lever. The state information of the operating lever includes, for example, whether the operating lever is in a no-operating state, whether the operating lever is controlling the boom, whether the operating lever is controlling the stick, or whether the operating lever is controlling the bucket and so on. Simultaneously, whether the operation information of the operating lever matches current state information of the boom, the stick or the bucket may be judged with reference to whether the boom inclination angle, the stick inclination angle, and the bucket inclination angle are within set ranges, so that a controller may perform corresponding control operations based on the above information.

S300: Controlling, based on a judgment result, operating states of an electronically controlled main valve and a main pump of the excavator.

Specifically, a matching state between the operation information, performed by the operator, of the operating lever and the current state information of the boom, the stick or the bucket may be obtained based on the judgment result, so as to control output flow of the main pump and hydraulic fluid flow and pressure from the electronically controlled main valve to the hydraulic cylinder, and then adjust a movement speed of each actuator (boom, stick, and bucket) to make it move according to an expected action and speed, thereby reducing the impact and vibration on the hydraulic cylinder and the working apparatus.

According to the apparatus, and the method for actively reducing the action impact of the excavator, and the excavator provided in an embodiment of the present disclosure, by collecting the boom inclination angle, the stick inclination angle, and the bucket inclination angle; positions of the boom, the stick, and the bucket may be obtained and then whether it is in a limit position or in a situation where a movement state is suddenly changed and so on may be learned based on a position attitude. After the above situation are learned, a current operation instruction of the operator may be learned based on the state information of the operating lever, and the actual control instruction may be determined with reference to the current attitude information of the boom, the stick and the bucket. The operating state of an electronically controlled main valve and a main pump may be controlled by the control instruction, thereby reducing an impact and vibration generated during operation, reducing a failure rate, improving service life and work efficiency.

Figure 2:
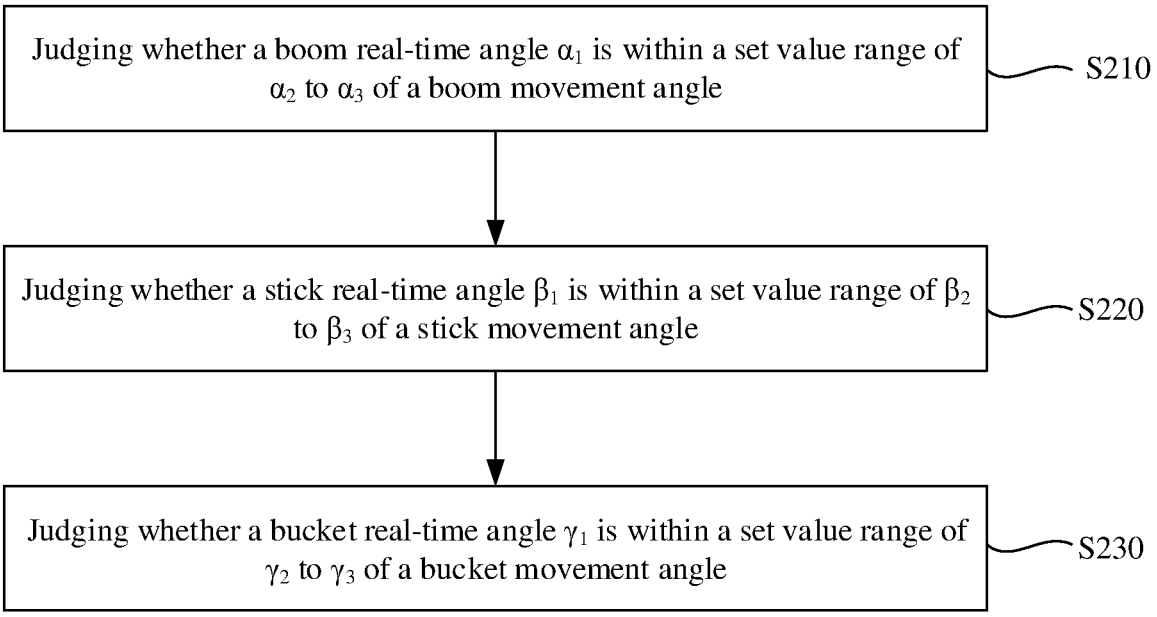
FIG. 2 is another flowchart of a method for actively reducing action impact of an excavator according to an embodiment of the present disclosure.

As shown in FIG. 2, the judging whether the boom inclination angle, the stick inclination angle, and the bucket inclination angle are within set ranges, includes the following steps.

S210: Judging whether a boom real-time angle $\alpha_1$ is within a set value range of $\alpha_2$ to $\alpha_3$ of a boom movement angle.

Specifically, the range between $\alpha_2$ and $\alpha_3$ may be considered as a safe zone for the boom movement. When the boom angle is within the range of $\alpha_2$ to $\alpha_3$, the boom is not at a limit position and a controller module may control the output flow of the main pump and the hydraulic fluid flow from the electronically controlled main valve to the hydraulic cylinder that controls the boom movement based on the position, thereby ensuring stable and efficient operation of the boom.

S220: Judging whether a stick real-time angle $\beta_1$ is within a set value range of $\beta_2$ to $\beta_3$ of a stick movement angle.

Specifically, the range between $\beta_2$ and $\beta_3$ may be considered as a safe zone for the stick movement. When the stick angle is within the range of $\beta_2$ to $\beta_3$, the stick is not at a limit position, the controller module may control the output flow of the main pump and the hydraulic fluid flow from the electronically controlled main valve to the hydraulic cylinder that controls the stick movement based on the position, thereby ensuring the stable and efficient operation of the stick.

S230: Judging whether a bucket real-time angle $\gamma_1$ is within a set value range of $\gamma_2$ to $\gamma_3$ of a bucket movement angle.

Specifically, the range between $\gamma_2$ and $\gamma_3$ may be considered as a safe zone for the bucket movement. When the bucket angle is within the range of $\gamma_2$ to $\gamma_3$, the bucket is not at a limit position, the controller module may control the output flow of the main pump and the hydraulic fluid flow from the electronically controlled main valve to the hydraulic cylinder that controls the bucket movement based on the position, thereby ensuring the stable and efficient operation of the bucket.

By judging whether the boom inclination angle, the stick inclination angle, and the bucket inclination angle are within the set ranges, the controller module may control the boom, the stick, and the bucket to move at a predetermined rate based on the ranges, so as to actively adjust the hydraulic fluid flow, that supplied to hydraulic cylinders corresponding to the working apparatus based on design parameters of the excavator and an intention of the operator, thereby reducing the impact and vibration on the working apparatus and the hydraulic cylinder during operation.

Figure 3:
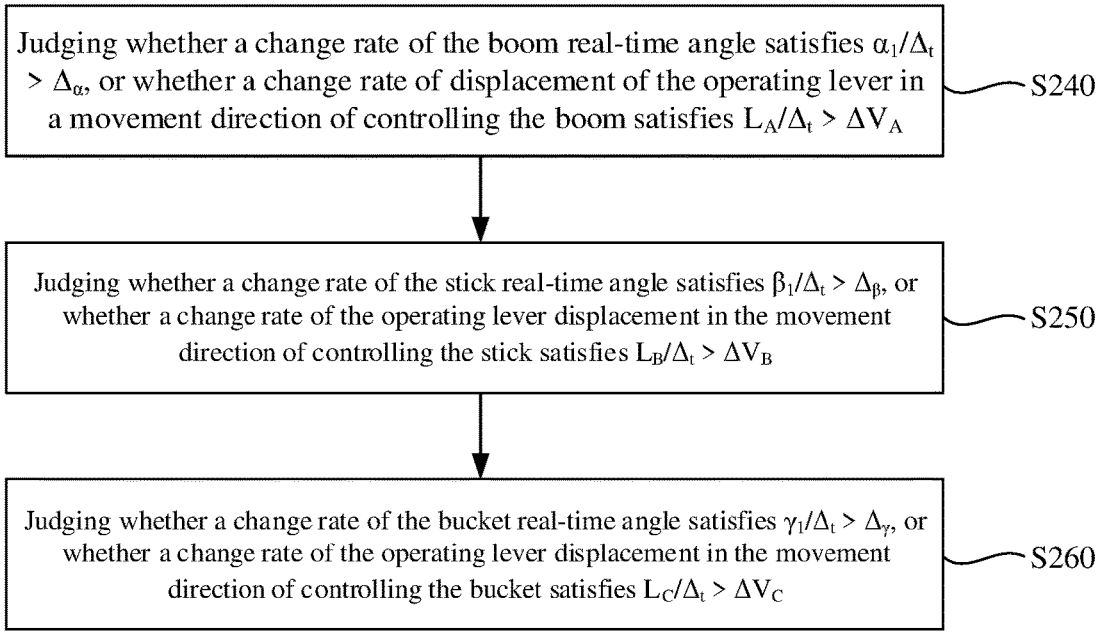
FIG. 3 is still another flowchart of a method for actively reducing action impact of an excavator according to an embodiment of the present disclosure.

As shown in FIG. 3, the judging whether the boom inclination angle, the stick inclination angle, and the bucket inclination angle are within set ranges further includes:

S240: Judging whether a change rate of the boom real-time angle satisfies $\alpha_1/\Delta_t>\Delta_\alpha$, or whether a change rate of displacement of the operating lever in a movement direction of controlling the boom satisfies $L_A/\Delta_t>\Delta V_A$.

If the above conditions are met, it indicates that the boom has a sudden movement, and the controller module may make a corresponding control operation according to the preset command under this condition.

S250: Judging whether a change rate of the stick real-time angle satisfies $\beta_1/\Delta_t>\Delta_\beta$, or whether a change rate of the operating lever displacement in the movement direction of controlling the stick satisfies $L_B/\Delta_t>\Delta V_B$.

If the above conditions are met, it indicates that the stick has a sudden movement, and the controller module may make a corresponding control operation according to the preset command under this condition.

S260: Judging whether a change rate of the bucket real-time angle satisfies $\gamma_1/\Delta_t>\Delta_\gamma$, or whether a change rate of the operating lever displacement in the movement direction of controlling the bucket satisfies $L_C/\Delta_t>\Delta V_C$.

If the above conditions are met, it indicates that the bucket has a sudden movement, and the controller module may make a corresponding control operation according to the preset command under this condition.

Therein, $\Delta_\alpha$ is a critical value of a change rate of a boom angle, $\Delta_\beta$ is a critical value of a change rate of a stick angle, $\Delta_\gamma$ is a critical value of a change rate of a bucket angle, $\Delta V_A$ is a critical value of the change rate of the displacement of the operating lever in the movement direction of controlling the boom, $\Delta V_B$ is a critical value of the change rate of the displacement of the operating lever in the movement direction of controlling the stick, and $\Delta V_C$ is a critical value of the change rate of the displacement of the operating lever in the movement direction of controlling the bucket.

Specifically, the controller module may also determine a component with a sudden movement and intensity of movement of the component based on differences of the value described above. Based on a current work mode of the excavator, the controller module calculate and output a control signal, using a fuzzy PID control algorithm, to an electronically controlled main pump and an electronically controlled main valve. The electronically controlled main valve and the main pump output required fluid pressure and flow, and control the working apparatus to move at a predetermined rate.

Optionally, the judging whether a boom real-time angle $\alpha_1$ is within a set value range of $\alpha_2$ to $\alpha_3$ of a boom movement angle further includes: when the boom real-time angle $\alpha_1$ is outside the set value range of $\alpha_2$ to $\alpha_3$ of the boom movement angle, judging whether an absolute value of a difference between the boom real-time angle $\alpha_1$ and $\alpha_{Min}$ is less than or equal to $\alpha_2$, or an absolute value of a difference between $\alpha_1$ and $\alpha_{Max}$ is less than or equal to $\alpha_3$, where the $\alpha_{Max}$ is a maximum of the boom movement angle, the $\alpha_{Min}$ is a minimum of the boom movement angle.

If the above conditions are met, it indicates that the boom moves to the limit position, and the controller module may calculate and output the preset control signal to the electronically controlled main valve and the main pump based on the current work mode of the excavator and the above parameters, and control the boom to move to the limit position at a predetermined rate.

Optionally, the judging whether a stick real-time angle $\beta_1$ is within a set value range of $\beta_2$ to $\beta_3$ of a stick movement angle further includes: when the stick real-time angle $\beta_1$ is outside the set value range of $\beta_2$ to $\beta_3$ of the stick movement angle, judging whether an absolute value of a difference between the stick real-time angle $\beta_1$ and $\beta_{Min}$ is less than or equal to $\beta_2$, or an absolute value of a difference between pi and $\beta_{Max}$ is less than or equal to $\beta_3$, where the $\beta_{Max}$ is a maximum of the stick movement angle, the $\beta_{Min}$ is a minimum of the stick movement angle.

If the above conditions are met, it indicates that the stick moves to a limit position, and the controller module may calculate and output the preset control signal to the electronically controlled main valve and the main pump based on the current work mode of the excavator and the above parameters, and control the stick to move to the limit position at a predetermined rate.

Optionally, the judging whether a bucket real-time angle $\gamma_1$ is between a set value $\gamma_2$ and a set value $\gamma_3$ of a bucket movement angle further includes: when the bucket real-time angle $\gamma_1$ is outside the set value range of $\gamma_2$ to $\gamma_3$ of the bucket movement angle, judging whether an absolute value of a difference between the bucket real-time angle $\gamma_1$ and $\gamma_{Min}$ is less than or equal to $\gamma_2$, or an absolute value of a difference between $\gamma_1$ and $\gamma_{Max}$ is less than or equal to $\gamma_3$, where the $\gamma_{Max}$ is a maximum of the bucket movement angle, the $\gamma_{Min}$ is a minimum of the bucket movement angle.

If the above conditions are met, it indicates that the bucket moves to a limit position, and the controller module may calculate and output the preset control signal to the electronically controlled main valve and the main pump based on the current work mode of the excavator and the above parameters, and control the bucket to move to the limit position at a predetermined rate.

Figure 4:
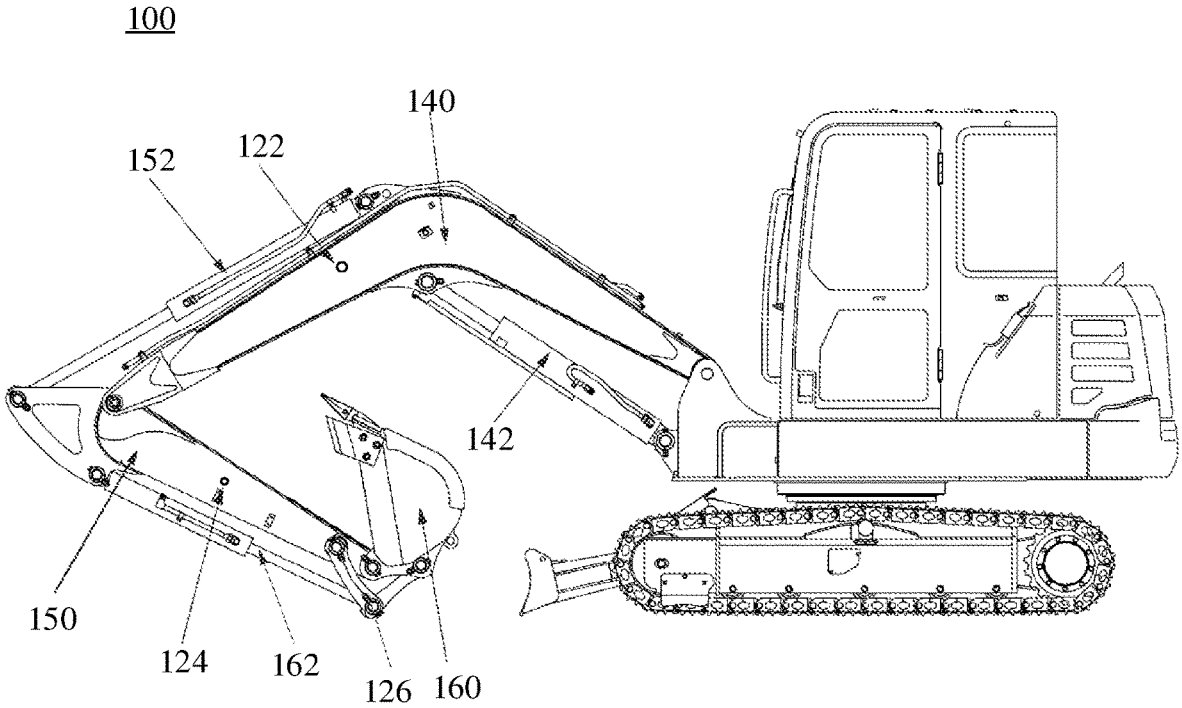
FIG. 4 is a schematic structural diagram of an apparatus for actively reducing action impact of an excavator according to an embodiment of the present disclosure.
Figure 5:
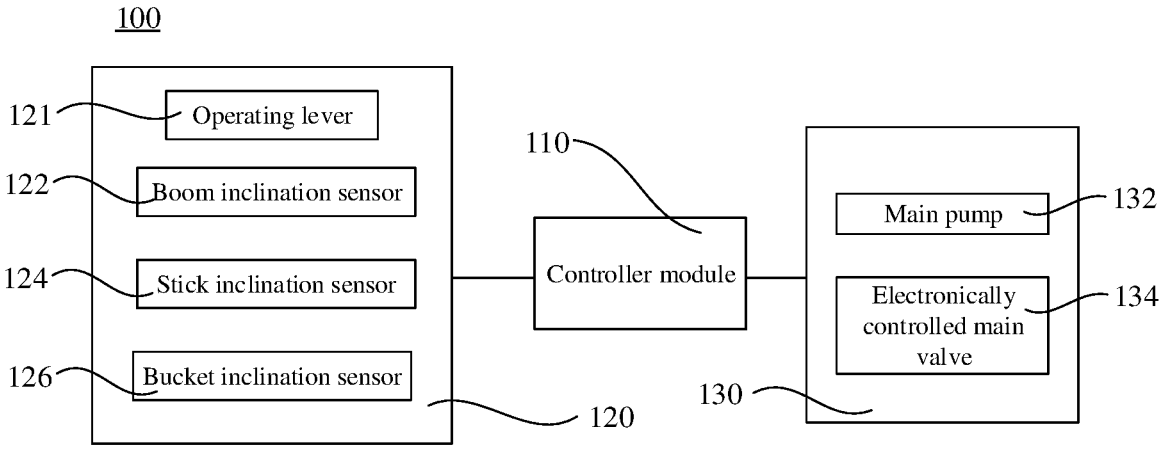
FIG. 5 is a schematic diagram of an electronic connection of an apparatus for actively reducing action impact of an excavator according to an embodiment of the present disclosure.

As shown in FIG. 4 and FIG. 5, an embodiment of the present disclosure further provides an apparatus 100 for actively reducing action impact of an excavator, including: a controller module 110, and a sensor module 120 and an operation module 130 electronically connected to the controller module 110 respectively, where the sensor module 120 includes an operating lever 121 connected to the controller module 110, a boom inclination angle sensor 122 disposed on a boom 140, a stick inclination angle sensor 124 disposed on a stick 150, and a bucket inclination angle sensor 126 disposed on a bucket 160; the operation module 130 includes a main pump 132 and an electronically controlled main valve 134 respectively connected to the controller module 110; and the controller module 110 is configured to control output flow of the main pump 132, and flow and pressure of the electronically controlled main valve 134 to each branch based on information collected from the sensor module 120 and the operating lever 121.

Specifically, the controller module 110 includes a sensor signal collection component, a data preprocessing component, a calculation component, and a control component. The controller completes a required functional operation through a cooperation of various components. The boom inclination angle sensor 122 may be arranged on the side of boom 140 to detect a real-time angle, gyro information and acceleration information of boom 140, and is connected to the sensor signal collection component, to facilitate the controller module 110 to collect information detected by the boom inclination angle sensor 122. Similarly, the stick inclination angle sensor 124 may be arranged on the side of the stick 150 to detect a real-time angle, gyro information and acceleration information of the stick 150, and is connected to the sensor signal collection component, to facilitate the controller module 110 to collect the information detected by the stick inclination angle sensor 124. The bucket inclination angle sensor 126 may be arranged at a position of a rotation pin to detect a real-time angle, gyro information and acceleration information of the bucket 160, and is connected to the sensor signal collection component, to facilitate the controller module 110 to collect information detected by the bucket inclination angle sensor 126.

The operating lever 121 may be an electronically controlled proportional operating lever 121, used to send the operation signal and state signal of the operating lever 121 to the controller module 110 through CAN bus when an operator manipulates the operating lever 121. The controller module 110 performs data analysis, conversion, filtering and algorithm operating on received information based on the action and state signals of the operating lever 121 output by the operating lever 121 and angle, gyro and acceleration signals of the working apparatus output by each inclination angle sensors, and outputs the control signals to the electronically controlled main valve 134 and the main pump 132, thereby controlling the output flow of the main pump 132 and the hydraulic fluid flow and pressure output from the electronically controlled main valve 134 to the hydraulic cylinder, and then adjust a movement speed of each actuator to make it move according to an expected action and speed, thereby reducing the impact and vibration on the hydraulic cylinder and working apparatus.

As shown in FIG. 4, the apparatus 100 for actively reducing action impact of an excavator further includes: a boom cylinder 142, a stick cylinder 152, and a bucket cylinder 162, where the boom cylinder 142 is connected to the boom 140 by drive connection, the stick cylinder 152 is connected to the stick 150 by drive connection, the bucket cylinder 162 is connected to the bucket 160 by drive connection, and the boom cylinder 142, the stick cylinder 152 and the bucket cylinder 162 are respectively connected to the electronically controlled main valve 134.

According to the above methods, the controller module 110 may obtain state information of the boom 140, the stick 150, and the bucket 160 based on the collected information of each inclination angle sensor, and in combination with the operation information of the operating lever 121, and may control the action of the boom cylinder 142, the stick cylinder 152 and the bucket cylinder 162 through controlling, by the controller module 110, the flow of the electrically controlled main pump 132 and the electrically controlled main valve 134, and the flow of each branch of the electrically controlled main valve 134, thereby controlling the boom 140, the stick 150 and the bucket 160. Therein, the controller module 110 may also be configured to be operated in multiple modes. For example, it may have three working modes including efficiency, energy saving, and normal to adapt to different work conditions and personnel operation. It should be noted that in the efficiency mode, the opening of the control main valve and the electronically controlled main valve 134 are slightly larger than that in the normal mode, when the collected state data are identical; in the energy saving mode, the opening of the control main valve and the electronically controlled main valve 134 are slightly smaller than the normal mode, when the collected state data are identical.

The apparatus 100 for actively reducing the action impact of excavator according to the present disclosure, may control the output pressure and flow of the electronically controlled main valve 134 and the main pump 132 based on an electronic control signal, sent by the controller module 110, based on the inclination angle sensor signal and the operating lever 121 signal, which is conducive to the electrification and intelligence upgrading of the excavator. Meanwhile, the apparatus may actively adjust the hydraulic fluid flow, that supplied to each cylinder, based on the design parameters of the excavator and the intention of the operator, thereby reducing the impact and vibration on the working apparatus and the hydraulic cylinder caused by the sudden start or stop of the working apparatus of excavator, and also reducing the impact and vibration of the working apparatus and hydraulic cylinder when the working apparatus moves to the limit position. In this way, an inexperienced excavator operator can easily operate the working apparatus, effectively protect the hydraulic cylinders and related components of each actuator, extend service life of related equipment, and reduce a failure rate of equipment. Moreover, it can also reduce the noise generated in the excavator workplace, make the equipment work more stable, improve the work efficiency, and improve the comfort experience of the operator.

Optionally, the apparatus 100 for actively reducing the action impact of excavator further includes a display screen, which is electronically connected to the controller module 110. In this way, the current operation is more intuitive through the human-computer interface, which is conducive to improving the operation experience.

An embodiment of the present disclosure further provides an excavator, including an apparatus for actively reducing the action impact of excavator 100 in the above embodiments. The excavator has the same structure and beneficial effects as the apparatus for actively reducing the action impact of excavator 100 in the above embodiments. The structure and beneficial effects of the apparatus for actively reducing the action impact of excavator 100 have been described in detail in the above embodiments, and are not described herein again.

The above embodiments are only the preferred embodiments of the present disclosure, and not intended to limit the scope protected by the present disclosure. Any modification, equivalent replacement, improvement, and so on, made in the spirit and principle of the present disclosure shall fall into the scope protected by the present disclosure.

What is claimed is:

1. A method for actively reducing an action impact of an excavator, comprising:

collecting a boom inclination angle, a stick inclination angle, a bucket inclination angle, and state information of an operating lever, of the excavator;

determining operation information of the operating lever, and judging whether the boom inclination angle, the stick inclination angle, and the bucket inclination angle are within set ranges; and controlling, based on a judgment result whether the boom inclination angle, the stick inclination angle, and the bucket inclination angle are within the set ranges, operating states of an electronically controlled main valve and a main pump of the excavator;

wherein the judging whether the boom inclination angle, the stick inclination angle, and the bucket inclination angle are within the set ranges, comprises:

judging whether a boom real-time angle $\alpha_1$ is within a set value range of $\alpha_2$ to $\alpha_3$ of a boom movement angle, wherein the set value range of $\alpha_2$ to $\alpha_3$ of the boom movement angle is a safe zone for a boom movement;

judging whether a stick real-time angle $\beta_1$ is within a set value range of $\beta_2$ to $\beta_3$ of a stick movement angle, wherein the set value range of $\beta_2$ to $\beta_3$ of the stick movement angle is a safe zone for a stick movement; and judging whether a bucket real-time angle $\gamma_1$ is within a set value range of $\gamma_2$ to $\gamma_3$ of a bucket movement angle, wherein the set value range of $\gamma_2$ to $\gamma_3$ of the bucket movement angle is a safe zone for a bucket movement;

judging whether a change rate of the boom real-time angle satisfies $\alpha_1/\Delta_t>\Delta_\alpha$, or whether a change rate of displacement of the operating lever in a movement direction of controlling the boom satisfies $L_A/\Delta_t>\Delta V_A$;

judging whether a change rate of the stick real-time angle satisfies $\beta_1/\Delta_t>\Delta_\beta$, or whether a change rate of displacement of the operating lever in a movement direction of controlling the stick satisfies $L_B/\Delta_t>\Delta V_B$; and judging whether a change rate of the bucket real-time angle satisfies $\gamma_1/\Delta_t>\Delta_\gamma$, or whether a change rate of displacement of the operating lever in a movement direction of controlling the bucket satisfies $L_C/\Delta_t>\Delta V_C$, wherein $\Delta_\alpha$ is a critical value of a change rate of a boom angle, $\Delta_\beta$ is a critical value of a change rate of a stick angle, $\Delta_\gamma$ is a critical value of a change rate of a bucket angle, $\Delta V_A$ is a critical value of the change rate of the displacement of the operating lever in the movement direction of controlling the boom, $\Delta V_B$ is a critical value of the change rate of the displacement of the operating lever in the movement direction of controlling the stick, $\Delta V_C$ is a critical value of the change rate of the displacement of the operating lever in the movement direction of controlling the bucket, $L_A$ is a displacement of the operating lever in the movement direction of controlling the boom, $L_B$ is a displacement of the operating lever in the movement direction of controlling the stick satisfies, $L_C$ is a displacement of the operating lever in the movement direction of controlling the bucket, and $\Delta_t$ is time duration of change.

2. The method for actively reducing the action impact of the excavator according to claim 1, wherein the judging whether the boom inclination angle, the stick inclination angle, and the bucket inclination angle are within set ranges further comprises:

when the boom real-time angle $\alpha_1$ is outside the set value range of $\alpha_2$ to $\alpha_3$ of the boom movement angle, judging whether an absolute value of a difference between the boom real-time angle $\alpha_1$ and $\alpha_{Min}$ is less than or equal to $\alpha_2$, or an absolute value of a difference between $\alpha_1$ and $\alpha_{Max}$ is less than or equal to $\alpha_3$, wherein $\alpha_{Max}$ is a maximum of the boom movement angle, and $\alpha_{Min}$ is a minimum of the boom movement angle.

3. The method for actively reducing the action impact of the excavator according to claim 1, wherein the judging whether the boom inclination angle, the stick inclination angle, and the bucket inclination angle are within set ranges further comprises:

when the stick real-time angle $\beta_1$ is outside the set value range of $\beta_2$ to $\beta_3$ of the stick movement angle, judging whether an absolute value of a difference between the stick real-time angle $\beta_1$ and $\beta_{Min}$ is less than or equal to $\beta_2$, or an absolute value of a difference between $\beta_1$ and $\beta_{Max}$ is less than or equal to $\beta_3$, wherein $\beta_{Max}$ is a maximum of the stick movement angle, and $\beta_{Min}$ is a minimum of the stick movement angle.

4. The method for actively reducing the action impact of the excavator according to claim 1, wherein the judging whether the boom inclination angle, the stick inclination angle, and the bucket inclination angle are within set ranges further comprises:

when the bucket real-time angle $\gamma_1$ is outside the set value range of $\gamma_2$ to $\gamma_3$ of the bucket movement angle, judging whether an absolute value of a difference between the bucket real-time angle $\gamma_1$ and $\gamma_{Min}$ is less than or equal to $\gamma_2$, or an absolute value of a difference between $\gamma_1$ and $\gamma_{Max}$ is less than or equal to $\gamma_3$, wherein $\gamma_{Max}$ is a maximum of the bucket movement angle, and $\gamma_{Min}$ is a minimum of the bucket movement angle.

* * * * *